United States Patent [19]

Pearson

[11] 4,217,673

[45] Aug. 19, 1980

[54] BROAD KNIFE FOR DRYWALL CORNERS

[75] Inventor: Robert J. Pearson, Tonawanda, N.Y.

[73] Assignee: National Gypsum Company, Dallas, Tex.

[21] Appl. No.: 5,485

[22] Filed: Jan. 22, 1979

[51] Int. Cl.[3] ..... B05C 17/10

[52] U.S. Cl. ..... 15/235.7

[58] Field of Search ..... 15/235.4, 235.5, 235.6, 15/235.7, 235.8

[56] References Cited

U.S. PATENT DOCUMENTS

| | | | |
|---|---|---|---|
| 1,566,515 | 12/1925 | Auld | 15/235.4 |
| 1,691,777 | 11/1928 | Mayes | 15/235.4 |
| 2,725,740 | 12/1955 | Borgstrom | 15/235.4 |

*Primary Examiner*—Edward L. Roberts

*Attorney, Agent, or Firm*—Robert F. Hause

[57] ABSTRACT

A broad knife for applying joint compound to one side of an inside corner, having compound previously applied to the other side, the blade of which knife has a small protuberance adjacent the side edge of the blade, on the top face, adapted to ride along the surface of the previously applied joint compound on the other corner side.

4 Claims, 3 Drawing Figures

BROAD KNIFE FOR DRYWALL CORNERS

This invention relates to a broad knife and to the use of the novel broad knife for applying joint compound in a drywall inside corner.

BACKGROUND OF THE INVENTION

In drywall construction, gypsum wallboards are affixed to vertical studs and horizontal joists to form the walls and ceilings of a room. Joint compounds are used to conceal the joints between adjacent boards and at corners. A paper joint tape is commonly used along with the joint compound to provide a bridging strength to the joint compound, when the compound dries or sets.

When applying joint compounds at inside corners, the compound, in a relatively stiff aqueous slurry form, is spread with a broad knife along a first wall adjacent the inside corner and then, after this had dried or set to a substantial degree, applying more of the same compound, relatively stiff aqueous slurry form, to the other, second wall adjacent the same corner.

A problem arises in applying the joint compound to the second wall if there happens to be a gap, between the two wallboards forming the inside corner, which the broad knife can slip into, as the compound is being applied with the knife. This problem is particularly aggravated if a paper tape is being used, as is most commonly the case.

It is very easy for the knife to be urged too tightly into the corner in applying joint compound to the second wall, moving, moving into the gap, mentioned above, creating a groove into the joint compound which had dried or set on the first wall. If joint tape is being used, this occurs as the tape is being bedded with compound, and the center portion of the tape is pushed into the gap.

SUMMARY OF THE INVENTION

To reduce substantially the possibility of the broad knife side edge moving into the gap at a drywall corner, a small protuberance is affixed to one face of the knife blade near at least one, and preferably both, front edge corners. When using the knife at an inside drywall corner, the protuberance is kept on the face away from the wall, and allowed to ride along the previously applied joint compound on an adjacent wall.

It is an object of the present invention to provide a novel broad knife for joint compound application to drywall inside corners.

It is a further object to provide a novel method of applying joint compound to drywall inside corners.

These and other objects of the invention will be more readily apparent when considered in relation to the preferred embodiments as set forth in the specification and shown in the drawings in which.

Figure 1:
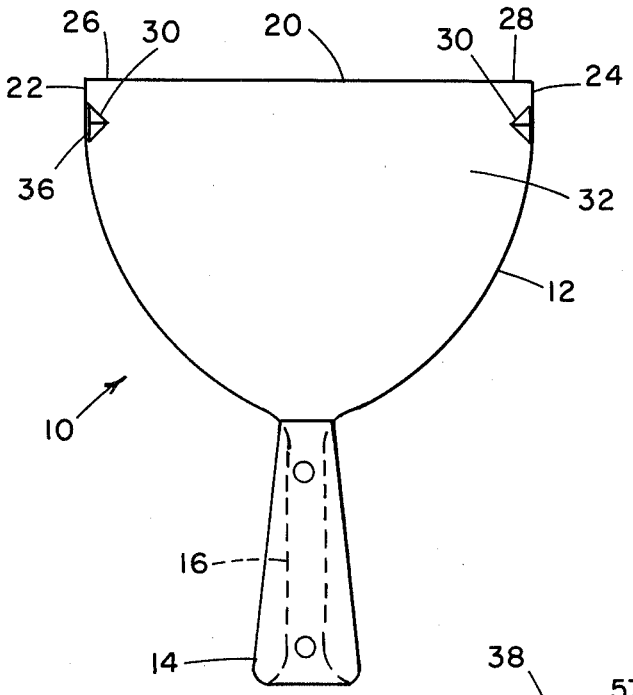
FIG. 1 is a top view of a broad knife embodying the present invention.
Figure 2:
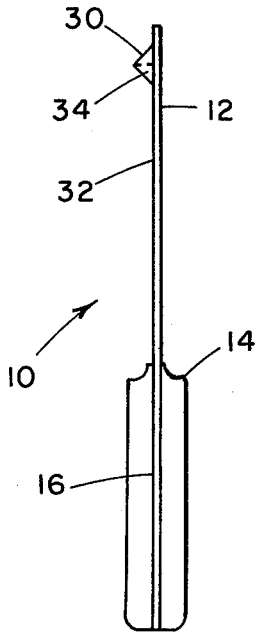
FIG. 2 is a side view of the knife of FIG. 1

Referring to FIGS. 1 and 2, a broad knife 10 is shown having a thin flat metal semi-rigid blade 12 and a handle 14 affixed to a rearward extending portion 16 of blade 12.

Blade 12 has a straight forward edge 20 extending across the full width of the blade, which width is preferably about three to six inches. Side edges 22, 24 extend rearwardly, from the two ends 26, 28 of forward edge 20, at an angle of about 90° to forward edge 20. Each side edge 22, 24 curves inwardly toward the rearward extending portion 16, each side edge 22, 24 forming substantially a quarter circle, in the common form of broad knives.

In accordance with the invention, two small protuberances 30, 30 are disposed on the top face 32 of blade 12, one near end 26 of forward edge 20 and the other near end 28 of forward edge 20. Each protuberance is a small molded plastic element adhesively held on the top face 32.

Each protuberance 30 preferably has a relatively smooth face 34 on the outer side 36 which is formed suitable for riding on the surface of a somewhat soft and penetrable coating of joint compound. As shown in the drawings, each protuberance 30 extends along only a minor portion of the extent of side edges 22, 24.

In a preferred embodiment, each protuberance 30 has a height of about one quarter inch, and a length along the blade side edge 22, 24 of about one-half inch. A width of approximately one quarter inch provides sufficient base area for adhesion of the plastic protuberance 30. The protuberances are disposed along the side edges 22, 24 or possibly a slight distance back therefrom. They are also spaced slightly from the corners at the ends 26, 28 of forward edge 20, such as about one-eighth inch.

The semi-pyramidal shape shown is merely one example of a suitable shape for protuberances 30, alternatives being cubes, quarter spheres or equivalent shapes having a base for adhesive application to the blade and smooth face 34 on outer side 36.

Figure 3:
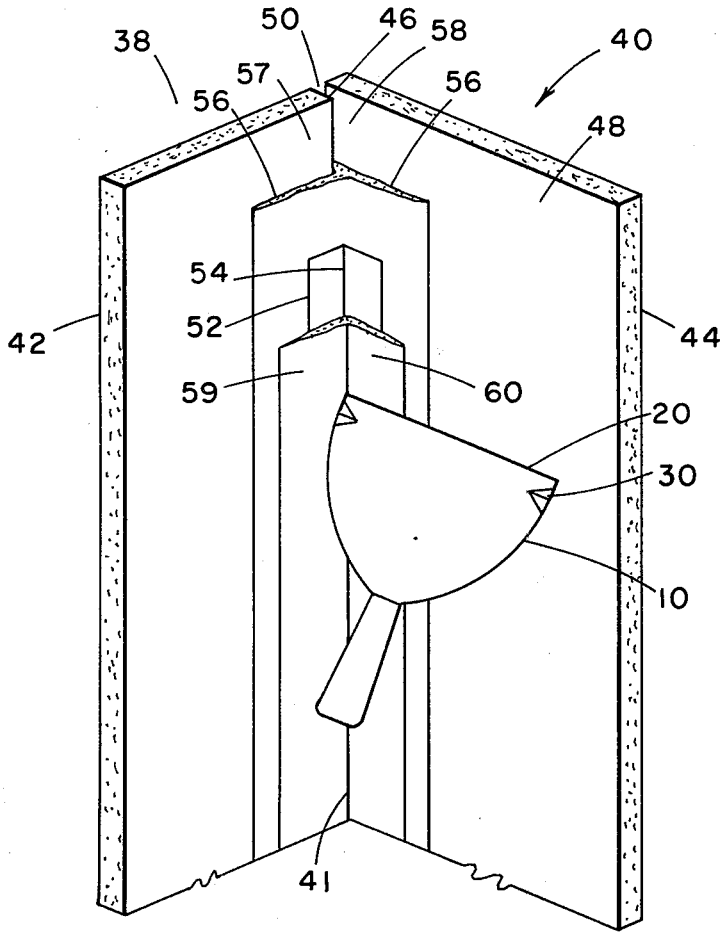
FIG. 3 is an isometric view of a drywall inside corner as joint compound is being applied in accordance with the invention.

Broad knife 10 is particularly adapted for use in applying joint compound to the second of two walls 38, 40 forming inside corner 41, as shown in FIG. 3. Walls 38 and 40 are constructed of gypsum wallboards 42, 44 with wallboard 42 having a vertical side edge 46 closely adjacent the outer face 48 of wall board 44, forming a gap 50 therebetween. Gap 50 extends in a direction parallel to the face 48 of wallboard 44 which forms the second wall 40.

Joint tape 52, which is a two-inch wide strip of paper, is folded along its center line 54. A thin layer 56 of an aqueous slurry of joint compound is disposed on the vertical face edges 57, 58 of wallboards 42, 44 and the joint tape 52 is embedded in the joint compound thin bed coat layer 56, using broad knife 10.

In embedding the tape 52 into the joint compound thin layer 56, the blade 12 is drawn downward with forward edge 20 pressing against the tape 52 forcing a portion of the joint compound of layer 56 out from under the tape 52, in order to ensure thorough contact of all of the tape with the joint compound thereunder.

Later the same day or on the following day, the workman applies a thin top coat 59 of an aqueous slurry of joint compound over the half of the tape 52 on wall 38. After this top coat 59 has dried or set to a substantial degree, the workman applies a similar top coat 60 over the half of tape 52 on wall 40.

In applying joint compound with knife 10, whether it be bedding the tape in bed coat layer 56 or applying to top coat 59, 60, an effort is made to make the joint compound have a smooth surface extending completely from the adjacent wall 38, 40 outward to the thin outer edge of the joint compound. To do this the workman allows the edge of the of the knife next to an adjacent wall 38, 40 to ride along the surface of the adjacent wall.

When using the knife to make a smooth coating on wall 40, the left edge 22 of knife blade 12 is riding along an opening into gap 50, tending to push tape 52 into the gap 50.

The novel protuberance 30 on the left edge of blade 12 rides along the surface of the tape 52 or top coat 59 on wall 38. By the presence of the protuberance 30 on blade 12, the tendency to push the center of the tape 52 into gap 50 is very substantially lessened.

As a result, the workman need not use the degree of care typical of a painter cutting in an edge with a paint brush, but instead can smooth the joint compound at about twice to four times the speed, of downward movement of the knife.

Having completed a detailed disclosure of the preferred embodiments of my invention, so that others may practice the same, I contemplate that variations may be made without departing from the essence of the invention.

I claim:

1. An improved broad knife for applying joint compound to drywall inside corners comprising a thin flat semi-rigid broad metal blade, a straight forward thin edge on the forward end of said broad knife blade having a length of about 3 to 6 inches, handle means at the rearward end of said blade, thin side edges on said blade extending rearwardly from each end of said forward edge at substantially a 90° angle and a small protuberance near at least one corner of said side edge and said forward edge on one face of said blade, said protuberance having a relatively smooth face on the side toward the adjacent side edge, extending along only a minor portion of the side edge and suitable for riding along the surface of a layer of joint compound adjacent a drywall corner.

2. A broad knife as defined in claim 1 wherein said protuberance extends outward from said one face of said blade about one quarter inch.

3. A broad knife as defined in claim 1 wherein said protuberance consists of a piece of molded plastic adhered to said one face of said blade.

4. A broad knife as defined in claim 1 wherein said one face of said blade has two protuberances one at each side thereof.

* * * * *